US005487552A

United States Patent [19]

Daoust

[11] Patent Number: 5,487,552

[45] Date of Patent: Jan. 30, 1996

[54] BRAKING MECHANISM FOR IN-LINE SKATES

[75] Inventor: Bernard Daoust, Montreal, Canada

[73] Assignee: Canstar Sports Group Inc., Ville Mont Royal, Canada

[21] Appl. No.: 266,354

[22] Filed: Jul. 1, 1994

[51] Int. Cl.[6] ..... A63C 17/14

[52] U.S. Cl. ..... 280/11.2; 280/11.22

[58] Field of Search ..... 280/11.19, 11.2, 280/11.27, 11.28, 11.22, 11.23; 188/5, 6

[56] References Cited

U.S. PATENT DOCUMENTS

| | | | |
|---|---|---|---|
| 920,848 | 5/1909 | Eubank, Jr. | 280/11.2 |
| 1,456,881 | 5/1923 | Carley | 280/11.2 |
| 1,497,224 | 6/1924 | Ormiston | 280/11.2 |
| 1,687,739 | 10/1925 | Slasher | 280/11.2 |
| 5,330,207 | 7/1994 | Mitchell | 280/11.2 |
| 5,374,070 | 12/1994 | Pellegrini, Jr. et al. | 280/11.2 |
| 5,397,137 | 3/1995 | Pellegrini, Jr. et al. | 280/11.2 |
| 5,435,579 | 7/1995 | Pozzabon | 280/11.2 |
| 5,439,238 | 8/1995 | Neal | 280/11.2 |

*Primary Examiner*—Richard M. Camby
*Attorney, Agent, or Firm*—R. Craig Armstrong

[57] ABSTRACT

The braking mechanism has two generally L-shaped levers, one on each side of the skate. Each lever has two arms, namely an upwardly projecting arm and a rearwardly projecting arm, pivotally connected to the chassis of the skate where the arms intersect, such that each upwardly projecting arm extends upwardly in general alignment with the skater's leg, and that each rearwardly projecting arm extends rearwardly from the chassis, the rearward distal ends having a brake pad secured beneath them. The upper distal ends may be connected to a pivotable boot cuff, but preferably instead have a generally C-shaped cup extending laterally between them, positionable behind the skater's calf. Rearward rotation of the skater's calf relative to the boot produces rearward movement of the upper distal ends, thereby moving the brake pad downwardly.

19 Claims, 2 Drawing Sheets

BRAKING MECHANISM FOR IN-LINE SKATES

BACKGROUND OF THE INVENTION

This invention relates to in-line skates, and specifically to a braking system for same.

In-line skating has become very popular as a sport and recreational activity. Associated sports such as in-line hockey and competitive in-line racing are growing exponentially.

For skaters at all levels of expertise, there is a particular need for improved braking systems, since in-line skates are capable of achieving speeds substantially greater than those typically achieved by conventional roller skates. By far the most common braking arrangement today is a heel brake, i.e. a brake pad mounted off the back of one or both skates. The skater brings the brake pad into contact with the ground by raising the toe of the skate to rotate it about the rear wheel and pressing down at the heel. Other known but Less common braking arrangements involve using brake shoes to bring brake pads directly into contact with one or more wheels, or using the equivalent of an automotive disc brake, i.e. bringing a brake pad into contact with another element which is connected to the wheel (as in an automotive disc brake). See U.S. Pat. No. 5,232,231 (Carlsmith) for an excellent general review of the prior art.

Most braking systems are actuated by changing the orientation of the whole boot, as is the case with heel brakes. However, other actuation means are known. For example, many patents involve the use of hand-actuated brake controls which lead to various braking means via cables which run down one or both legs of the skater.

Such cable arrangements achieve a highly desirable object, namely to permit braking while enabling the skater to keep all wheels still on the ground. However, in practice they are fundamentally impractical, since either the brake is not instantaneously available, or the skater has to have a brake control held in his or her hand, which restricts freedom of movement, interferes with balance, and increases the possibility of injury during the inevitable falls.

It would be highly advantageous to have a braking system which permitted braking with all wheels still essentially on the ground, but which did not require hand controls. Several rather old patents show early attempts to achieve this. For example, U.S. Pat. Nos. 920,848 (Eubank), 1,402,010 (Ormiston) and 1,497,224 (Ormiston) all show straps which are adapted to buckle about the ankle of the skater, and which are connected to actuate the brake when the ankle is rotated forwardly (Eubank) or rearwardly (both Ormiston patents) relative to the skate.

It follows that there is a need for a braking system which permits braking with all wheels remaining essentially on the ground, but which does not require hand controls. At the same time, the system must readily lend itself to present in-line skates designs without major modifications to the overall structure, and must deliver sufficient braking force for adequate speed control.

Cuff-activated systems are known, in which rearward rotation of the cuff of the boot forces an assembly downwardly, the downward movement pressing a pivotally-mounted brake pad against the ground. However, there remains a need for a simple system which can achieve effective braking while allowing the skater the option of leaving all wheels on the ground for balance at least during initial braking, without the complexity connection to the cuff of the boot.

SUMMARY OF THE INVENTION

It is an object of the invention to provide such an improved braking system.

In the invention, it was realized that the objects could be achieved by providing a braking system activated by movement of the skater's leg relative to the foot.

Accordingly, the invention provides a braking mechanism having two generally L-shaped levers, one on each side of the skate. Each lever has two arms, namely an upwardly projecting arm and a rearwardly projecting arm, pivotally connected to the chassis of the skate where the arms intersect, such that each upwardly projecting arm extends upwardly towards the rear of the skater's calf, and such that each rearwardly projecting arm extends rearwardly from the chassis. The rearward distal ends having a brake pad secured beneath them. The upper distal ends may be connected to a pivotable boot cuff, but preferably instead have a braking pressure receiving means such as a generally C-shaped cup mounted on or extending laterally between them, positionable behind the skater's calf. Rearward rotation of the skater's calf relative to the boot produces rearward movement of the upper distal ends, thereby moving the brake pad downwardly by virtue of rotation of the levers about the pivotal connections.

The pivotal connections between the levers and the chassis may be co-axial with the first or second wheel forward from the rear of the skate, or may be connected to the chassis at a point not co-axial with any of the wheels. The position of the pivotal connections may be selected by the designer in order to achieve whatever mechanical advantage the designer desires (typically but not necessarily at least 2:1).

Preferably, the brake pad is adjustable upwardly or downwardly with respect to the rearwardly projecting arm, or the upwardly extending arms are not integral with the rearwardly extending arms, and the angle between the arms may be adjusted.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

Figure 1:
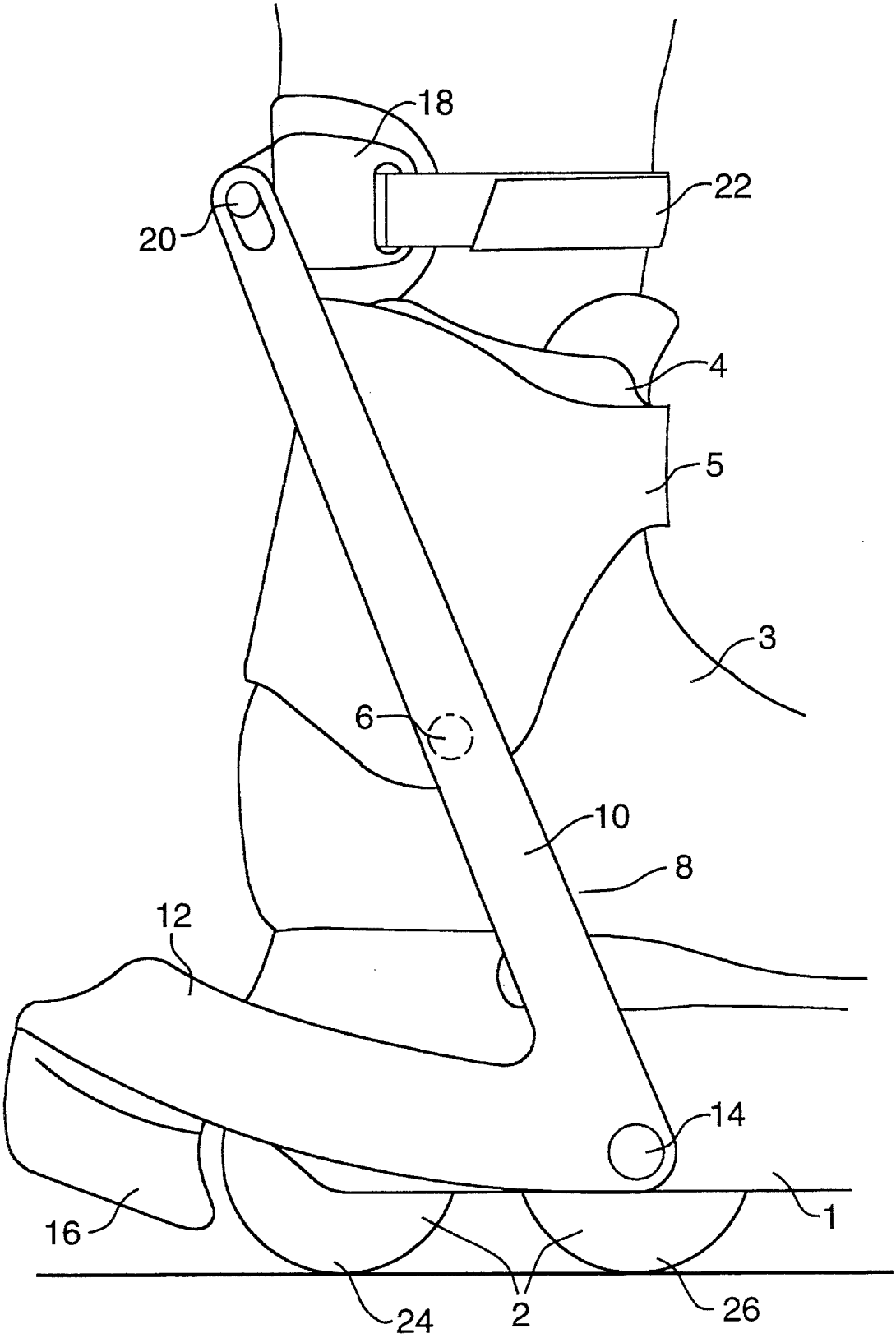
FIG. 1 is a side view of the skate, showing the brake unactivated.
Figure 2:
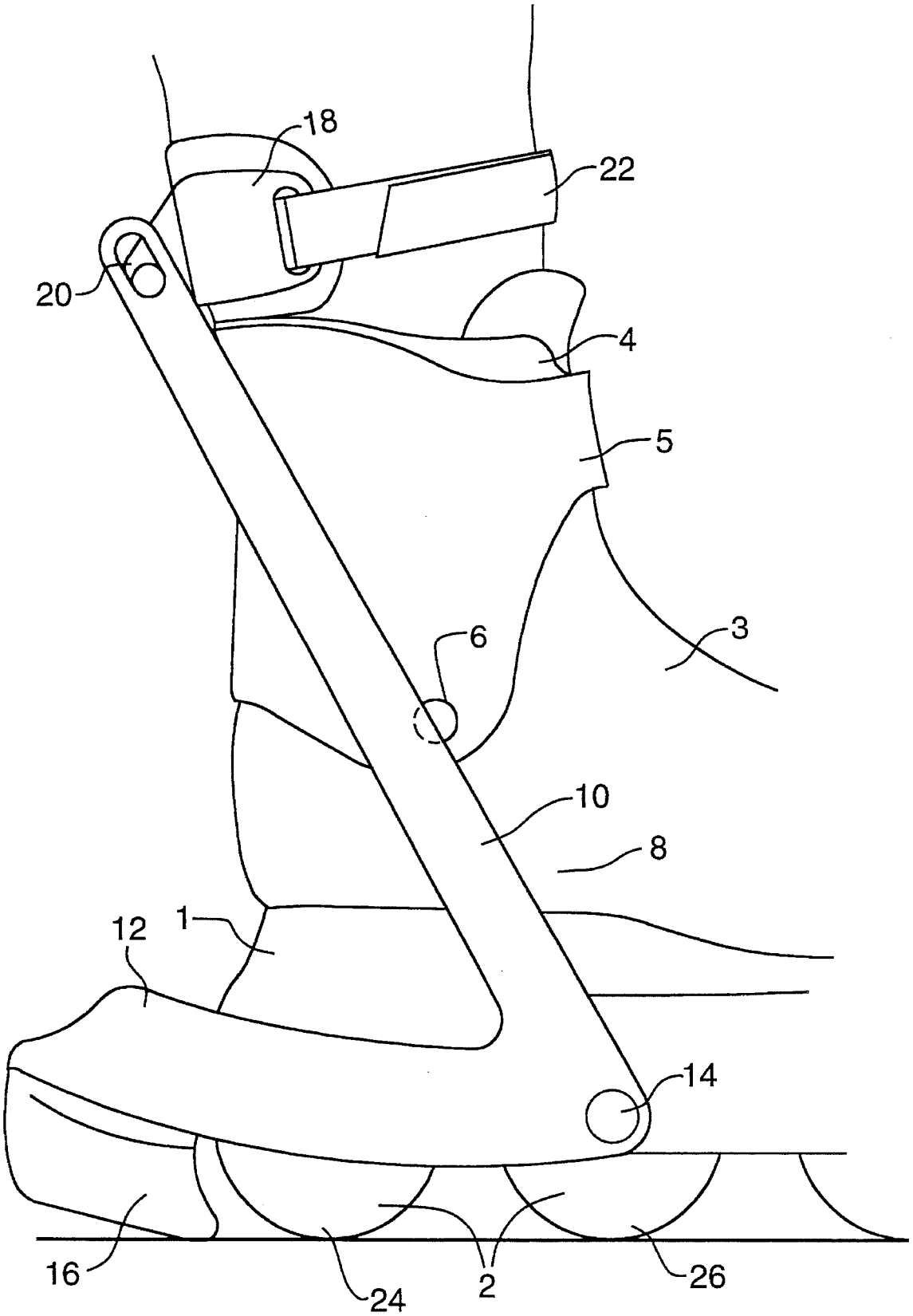
FIG. 2 is a side view of the skate, showing the brake activated.

Referring to the drawings, the main components of the skate itself are: a chassis 1, which carries a plurality of wheels 2; a boot 3; a liner 4; and a cuff 5. The liner 4 is a generally conventional flexible padded sock-like structure, which fits within the boot.

The cuff 5 preferably is pivotally connected to the boot, or to upward extensions of the chassis, at pivot points 6, so that the leg may be rotated rearwardly relative to the boot with minimal restriction. The pivot points are on lateral and medial sides of the skate, preferably in alignment with the skater's malleoli.

The above structures are conventional.

In the invention, the braking mechanism has two generally L-shaped levers 8, one on each side of the skate. Each lever has two arms, namely an upwardly projecting arm 10 and a rearwardly projecting arm 12, pivotally connected to the chassis of the skate at pivot points 14 where the arms intersect, such that each upwardly projecting arm extends upwardly towards the rear of the skater's calf, and that each rearwardly projecting arm extends rearwardly from the chassis, the rearward distal ends having a brake pad 16 secured beneath them. The upper distal ends may be connected to the pivotable boot cuff, but preferably instead have a braking pressure receiving means such as a generally C-shaped cup 18 mounted on joined upper distal ends, or extending laterally between them with a slotted mount 20, the cup being positionable behind the skater's calf. Rearward rotation of the skater's calf relative to the boot produces rearward movement of the upper distal ends, thereby moving the brake pad downwardly by virtue of rotation of the levers about the pivotal connections, to engage the ground.

In order to avoid dragging the brake pad, and to return it to the unactivated position, a strap 22 may be employed to secure the cup 18 behind the skater's calf. Alternatively, a return spring (not shown) may be connected at any suitable location between either one of the arms on either or both sides of the skate, to the boot or chassis, to lightly bias the brake pad away from the ground.

The pivotal connections between the levers and the chassis may be co-axial with the first wheel 24 or second wheel 26 forward from the rear of the skate, or may be connected to the chassis at a point not co-axial with any of the wheels.

Preferably, the brake pad 16 is adjustable upwardly or downwardly with respect to the rearwardly projecting arm, or the upwardly extending arms are not integral as illustrated, but rather are connected together with an adjustable connection such that the angle between the arms may be adjusted. Either of these arrangements allows for adjustment to suit personal preference, or to allow for brake wear.

A particular advantage of the invention is that when one wants to "put on the brakes" to slow down, putting one foot forward is a natural reaction, which is precisely what will put the brakes on, via rearward rotation of the calf relative to the boot. The farther the foot is put forward and the more the calf is rotated rearwardly, the greater the braking power, which again is highly desirable. The result is very natural or "intuitive" braking.

It is particularly advantageous that the invention provides for a mechanical advantage which is generally well in excess of one, and may be as high as three or more, e.g. where the upwardly extending arm is relatively long and where the pivotal connection is at or near the first wheel 20.

It will be appreciated that the above description relates to the preferred embodiment by way of example only. Many variations on the invention will be obvious to those knowledgeable in the field, and such obvious variations are within the scope of the invention as described and claimed, whether or not expressly described.

In one variation, for example, not illustrated, the cuff 5 may have outwardly flared channels to accommodate the upwardly extending lever arms, such that the upwardly extending lever arms are positioned inwardly of at least a portion of the cuff rather than being fully exposed. In this embodiment, the lever arms would not be actually connected to the cuff in any way.

In another variation, also not specifically illustrated, the upwardly projecting arms curve around behind the boot and are joined to each other, thence projecting upwardly together as a unit to the area behind the calf, and having a generally C-shaped cuff mounted there.

I claim:

1. A braking mechanism for an in-line skate, said skate having a boot and a wheel-carrying chassis secured beneath said boot, said braking mechanism comprising two generally L-shaped levers, configured for positioning one on each side of the skate, each lever having two arms, comprising an upwardly projecting arm and a rearwardly projecting arm, the area of each said lever where said arms of said lever intersect being configured for pivotal connection to said chassis at one of corresponding pivotal connections on each side of the chassis, such that when so connected at one of said pivotal connections, each said upwardly projecting arm extends upwardly from said pivotal connection towards the rear of the calf of a skater wearing said skate, to an upper distal end, and such that each said rearwardly projecting arm extends rearwardly from said wheel chassis to a rearward distal end, said rearward distal ends being joined and having a brake pad secured beneath them, said upper distal ends having a braking pressure receiving means mounted on or extending laterally between them, configured for positioning behind the skater's calf, whereby rearward rotation of the skater's calf relative to the boot, when said braking mechanism is installed, produces rearward movement of said upper distal ends, thereby moving said brake pad downwardly by virtue of rotation of said levers about said pivotal connections, to engage the ground.

2. A braking mechanism as recited in claim 1, configured such that each said pivotal connection may be connected to said chassis co-axially with a second wheel forward from the rear of the skate.

3. A braking mechanism as recited in claim 2, such that the distance from each said pivotal connection to said braking pressure receiving means is at least about two times the distance from each said pivotal connection to the center of said brake pad.

4. A braking mechanism as recited in claim 1, configured such that each said pivotal connection may be connected to said chassis co-axially with a first wheel forward from the rear of the skate.

5. A braking mechanism as recited in claim 4, such that the distance from each said pivotal connection to said braking pressure receiving means is at least about three times the distance from each said pivotal connection to the center of said brake pad.

6. A braking mechanism as recited in claim 1, configured such that each said pivotal connection is at a point not co-axial with one of the wheels, such that the distance from said each pivotal connection to said braking pressure receiving means is at least about two times the distance from each said pivotal connection to the center of said brake pad.

7. A braking mechanism as recited in claim 1, where said brake pad is adjustable upwardly or downwardly with respect to said rearwardly projecting arm.

8. A braking mechanism as recited in claim 1, where said upwardly extending arms are not integral with said rearwardly extending arms, but rather said arms are connected to each other, said connection being adjustable such that the angle between said arms may be varied.

9. A braking mechanism as recited in claim 1, where said upper distal ends are securable around the skater's calf by straps attached to said mechanism in the area of said upper distal ends.

10. A braking mechanism as recited in claim 1, further comprising a spring mounted between at least one of said levers and said skate to bias said brake pad away from the ground, whereby said brake pad is lifted away from the ground when said braking pressure is removed from said braking pressure receiving means.

11. A braking mechanism as recited in claim 1, where said braking pressure receiving means is a generally C-shaped cup corresponding generally to the shape of the rear of a skater's calf.

12. An in-line skate and braking mechanism for said skate, said skate having a wheel-carrying chassis secured beneath a boot, said boot having a cuff pivotally mounted to thereto for rotation generally about the area of malleoli of a skater wearing a skate, said braking mechanism comprising two generally L-shaped levers, positioned one on each side of the skate, each lever having two arms, comprising an upwardly projecting arm and a rearwardly projecting arm, the area of each said lever where said arms of said lever intersect being pivotally connected to said chassis at one of corresponding pivotal connections on each side of the chassis, such that each said upwardly projecting arm extends upwardly from said pivotal connection towards the rear of the calf of the skater, to an upper distal end, and such that each said rearwardly projecting arm extends rearwardly from said wheel chassis to a rearward distal end, said rearward distal ends being joined and having a brake pad secured beneath them, said upper distal ends being secured to said cuff such that the rearward rotation of said cuff relative to the boot produces rearward movement of said upper distal ends, thereby moving said brake pad downwardly by virtue of rotation of said levers about said pivotal connections to engage the ground.

13. An in-line skate and braking mechanism as recited in claim 12, configured such that said pivotal connections are co-axial with a second wheel forward from the rear of the skate.

14. An in-line skate and braking mechanism as recited in claim 13, such that the distance from said pivotal connecting to said braking pressure receiving means is at least about two times the distance from said pivotal connections to the center of said brake pad.

15. An in-line skate and braking mechanism as recited in claim 12, configured such that said pivotal connections are connected to said chassis co-axially with a first wheel forward from the rear of the skate.

16. An in-line skate and braking mechanism as recited in claim 15, such that the distance from said pivotal connections to said braking pressure receiving means is at least about three times the distance from said pivotal connections to the center of said brake pad.

17. An in-line skate and braking mechanism as recited in claim 12, configured such that said pivotal connections are connected to said chassis at a point not co-axial with one of the wheels, such that the distance from said pivotal connections to said braking pressure receiving means is at least about two times the distance from said pivotal connections to the center of said brake pad.

18. An in-line skate and braking mechanism as recited in claim 12, where said brake pad is adjustable upwardly or downwardly with respect to said rearwardly projecting arm.

19. An in-line skate and braking mechanism as recited in claim 12, where said upwardly extending arms are not integral with said rearwardly extending arms, but rather said arms are connected to each other, said connection being adjustable such that the angle between said arms may be varied.

* * * * *

UNITED STATES PATENT AND TRADEMARK OFFICE

CERTIFICATE OF CORRECTION

PATENT NO. : 5,487,552
DATED : January 30, 1996
INVENTOR(S) : Bernard Daoust

It is certified that error appears in the above-indentified patent and that said Letters Patent is hereby corrected as shown below:

Claim 12, column 5,
line 30, insert --,-- after --connections--.

Claim 14, column 6, line 2, "connecting" should read --connections--.

Signed and Sealed this
Fourth Day of November, 1997

*Attest:*

*Attesting Officer*

BRUCE LEHMAN

*Commissioner of Patents and Trademarks*